US005447290A

United States Patent [19]

Workman

[11] Patent Number: 5,447,290

[45] Date of Patent: Sep. 5, 1995

[54] RAIL FOR GUARDING REINFORCEMENT BARS

[75] Inventor: Gary L. Workman, Lombard, Ill.

[73] Assignee: Deslauriers, Inc., Bellwood, Ill.

[21] Appl. No.: 124,273

[22] Filed: Sep. 20, 1993

[51] Int. Cl.[6] ..... E04H 17/14

[52] U.S. Cl. ..... 256/59; 256/65; 52/300; 52/301

[58] Field of Search ..... 256/59, 65; 52/33, 174, 52/300, 301, 566

[56] References Cited

U.S. PATENT DOCUMENTS

| | | | |
|---|---|---|---|
| 2,632,479 | 3/1953 | Pfeil et al. | 138/96 T |
| 2,873,765 | 2/1959 | Gregory | 138/96 R |
| 3,065,767 | 11/1962 | Topf | 138/89 |
| 3,160,175 | 12/1964 | Laemmle | 138/109 |
| 3,174,588 | 3/1965 | Kessler | 52/103 |
| 3,847,183 | 11/1974 | Meyer | 138/96 R |
| 4,027,855 | 6/1977 | Lauzier | 256/59 |
| 4,202,378 | 5/1980 | Bush et al. | 138/96 R |
| 4,220,316 | 9/1980 | Naka et al. | 256/59 |
| 5,200,240 | 4/1993 | Baker | 256/59 |

OTHER PUBLICATIONS

Reo Sok protective cap circular, REO SOK, Patent Pending PJ 9427, Australia, No Date.

Econ-O-Guard Protection Cap spec sheet, DesLauriers, Inc., May 1, 1993.

*Primary Examiner*—Richard A. Bertsch
*Assistant Examiner*—Howard R. Richman
*Attorney, Agent, or Firm*—Wood, Phillips, VanSanten, Clark & Mortimer

[57] ABSTRACT

A guard rail for use with linearly-arranged reinforcement bars is provided, the guard rail including a housing for guarding reinforcement bars with the housing including structure for capturing the reinforcement bars therein, and structure on the capturing structure for guiding movement of the capturing structure between a non-secured position and a position wherein the housing is securely maintained in a guarding position over the reinforcement bars extending into the housing.

14 Claims, 2 Drawing Sheets

RAIL FOR GUARDING REINFORCEMENT BARS

This invention relates to guard rails and, more particularly, to guard rails for use with reinforcement bars.

BACKGROUND OF THE INVENTION

Presently, there is a need for devices to prevent injury through inadvertent contact with exposed reinforcement bars used in the construction industry. Workers who accidentally contact exposed reinforcement bars can sustain injuries ranging from scratches and cuts to impalement.

Most commercially available devices do not adequately guard reinforcement bars so as to protect against serious injury. For example, applicant's assignee offers an Econ-O-Guard protection cap which is individually fitted over the exposed ends of reinforcement bars. While these caps prevent minor injuries, such as scratches and cuts associated with accidental contact with reinforcement bars, the caps may not prevent impalement.

Another device employs a two-piece construction to guard reinforcement bars. A cap receives the exposed end of a reinforcement bar and is provided with a gap therein so that a row of reinforcement bars can be guarded by placing a protection bar in the aligned gaps of the caps. If any reinforcement bars extend beyond the remaining reinforcement bars in the row, they need to be cut to create a level line so that the protective bar can rest in the gap provided in each cap. This problem is exacerbated when, for instance, only one bar in a row of bars is lower than the others leaving the lower bar unprotected by the protective bar or requiring cutting of each bar to the height of the lower bar before the protective bar can be effectively used. Moreover, since the protective bar only clips into the gap of the protective caps, it is impossible for this device to be securely used with reinforcement bars that protrude horizontally unless the protective bar is supported in some other fashion, such as by tying the protective bar to the reinforcement bar, so that the protective bar does not become displaced from the caps.

SUMMARY OF THE INVENTION

The present invention is specifically directed to overcoming the above enumerated problems in a novel and simple manner.

According to the invention, a guard rail for use with linearly-arranged reinforcement bars is provided, the guard rail including a housing for guarding reinforcement bars with the housing including structure for capturing the reinforcement bars therein, and structure on the capturing structure for guiding movement of the capturing structure between a non-secured position and a position wherein the housing is securely maintained in a guarding position over the reinforcement bars extending into the housing.

Preferably, the housing includes an insert to be placed over the reinforcement bars in a guarding position where the cooperating structure securely maintains the insert in the guarding position over reinforcement bars extending into the housing. In another preferred form, the housing is formed from a plastic material and includes a top wall and two opposing side walls downwardly depending from the top wall so that the walls cooperate to define a channel having upper and lower regions. In one exemplary embodiment, the capturing structure is the lower portions of the side walls, with the side wall lower portions extending towards each other so that reinforcement bars can be captured between the side wall lower portions. In another preferred form, the insert is an elongate strip of metal extending within the housing channel adjacent to the housing walls.

In yet another preferred form, the cooperating structure extends through the capturing structure to guide movement of the capturing structure between the non-secured position and the position wherein the housing is securely maintained in the guarding position over the reinforcement bars extending therein. In one exemplary embodiment, the cooperating structure is a nut and a bolt, with the bolt extending through aligned holes in the side walls of the housing thereby biasing the side walls towards each other when tightened so that the reinforcement bars are captured therebetween.

In another aspect of the invention, the side walls are provided with integral portions depending inwardly from the lower portions of the side walls and integral portions depending upwardly and inwardly from the inwardly depending portions.

In still yet another preferred form, the housing is a severable extruded plastic piece so that the housing can be cut to accommodate a variable range of reinforcement bars therein. Another aspect of the invention is to provide ridges extending along the housing side walls in the upper channel region of the housing to support the insert in the housing.

DETAILED DESCRIPTION OF THE DRAWINGS

Figures 1, 2, 3:
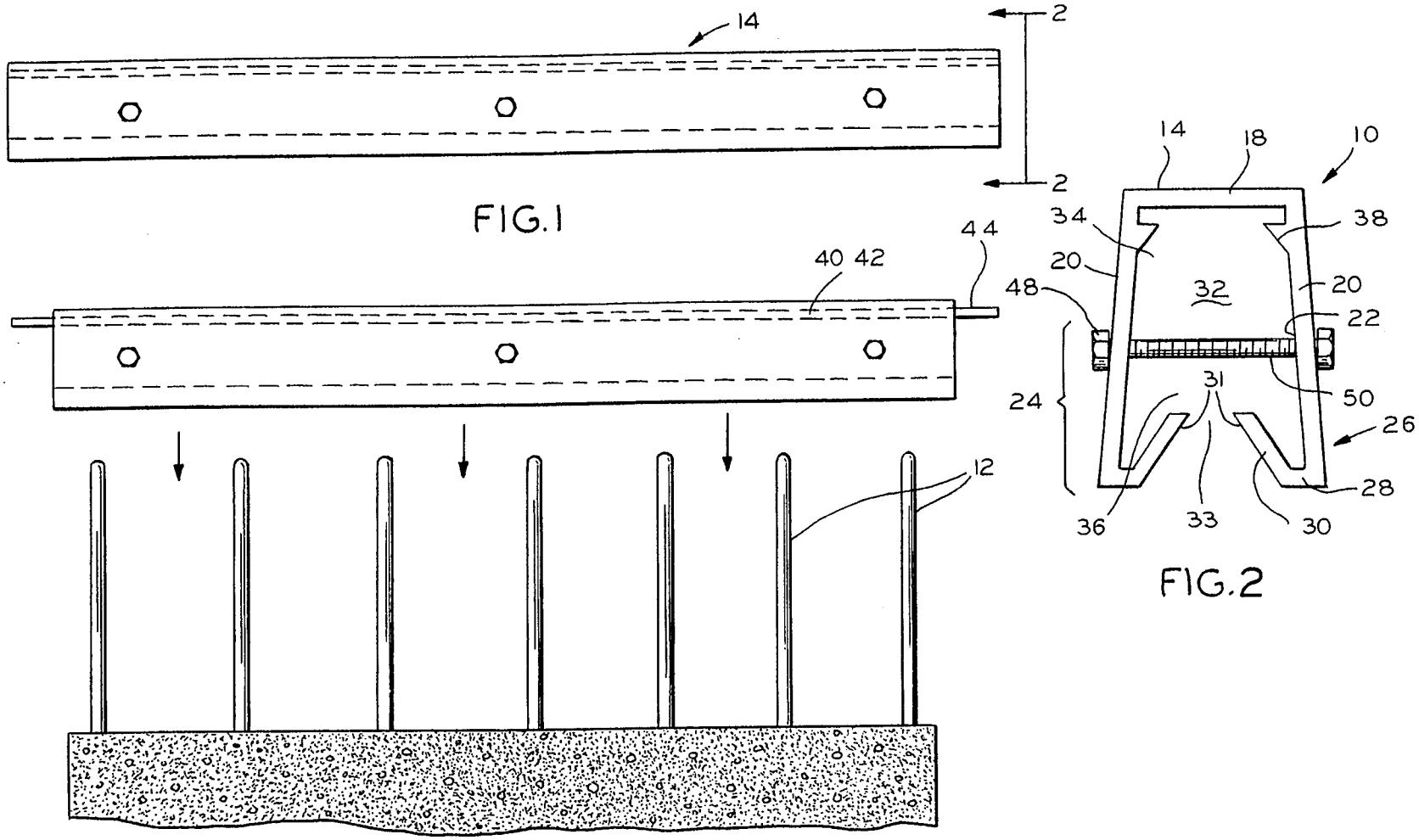
FIG. 1 is a side view of a housing according to the invention.
FIG. 2 is a cross-sectional view taken along the line 2—2 of FIG. 1.
FIG. 3 shows the housing before placement over linearly arranged reinforcement bars.

FIG. 1 shows a guard rail 10 before placement over reinforcement bars 12. The guard rail 10 has a housing 14 made from an extruded plastic material.

Referring to FIG. 2, the plastic housing 14 has a top wall 18 connected with two downwardly-depending opposite side walls 20. The side walls 20 are angled slightly away from one another as they depend downward from the top wall 18. Aligned holes 22 are provided in each of the side walls 20 so that every hole 22 on one side wall 20 has a corresponding aligned hole across from it on the other side wall 20.

Lower portions 26 of the side walls 20 are provided for capturing reinforcement bars extending into the housing 14. The lower portions 26 include first integral strip portions 28 depending inwardly parallel to the top wall 18 with second integral strip portions 30 depending upwardly and inwardly from first inwardly depending strip portions 28. The second strip portions 30 are provided with distal bearing surfaces 31 which, in use, bear against the reinforcement bars 12 to thereby capture the reinforcement bars 12 therebetween. While the second strip portions 30 extend towards one another, a space 33 is provided therebetween to accommodate reinforcement bars 12 therethrough.

The top wall 18 and the side walls 20 of the plastic housing 14 cooperate to define an elongate channel 32 extending therethrough having upper and lower channel regions 34,36, respectively.

Figure 5:
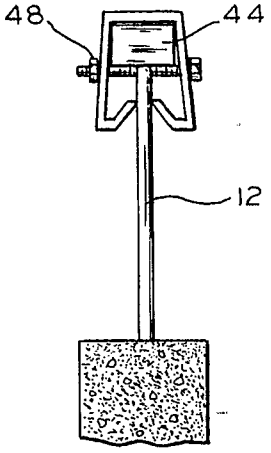
FIG. 5 is a side view of the housing in a guarding position over reinforcement bars.
Figure 4:
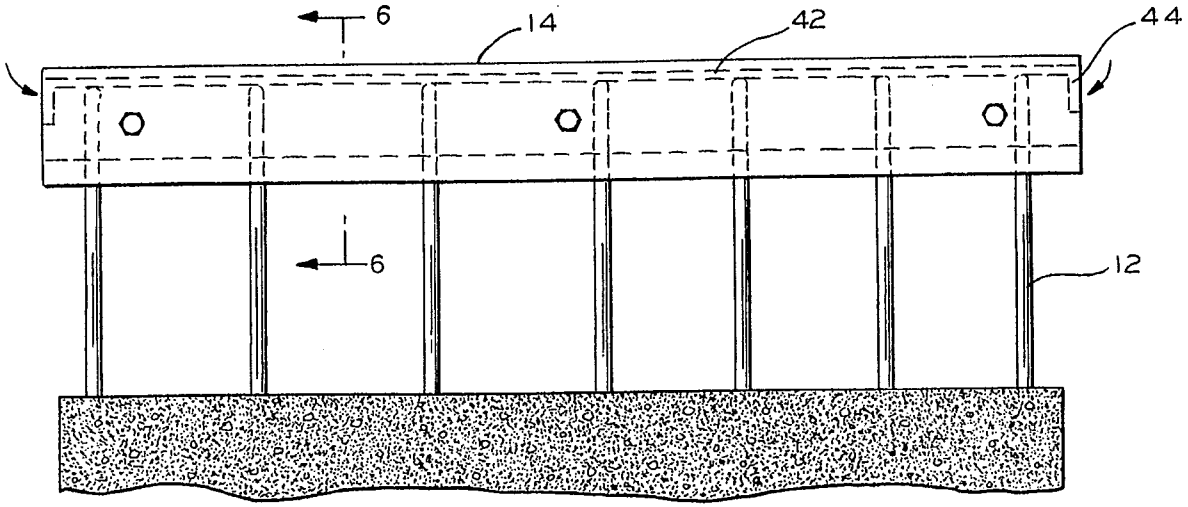
FIG. 4 shows the housing placed over reinforcement bars.

The side walls 20 of the housing 14 are each provided with a ridge 38 which extends lengthwise along the inside of the side wall 20 and are disposed in the upper region 34 of the housing 14. The ridges 38 provide support for an insert 40 that can be used in the housing 14. The ridges 38 hold the insert 40 flush against the top wall 18 of the housing 14 so that the insert 40 is essentially an integral part of the housing 14. Preferably, the insert 40 is an elongate metal strip 42 having ends 44 thereof. Most preferably, the elongate metal strip 42 is made from a steel material. The ends 44 are capable of being angled, as seen in FIGS. 4 and 5, so that the ends 44 extend towards the lower channel region 36 of the housing 14 and do not protrude therefrom thereby avoiding any possibility of injury through contact with exposed ends 44 of the insert 40. In addition, if the reinforcement bars 12 begin to move laterally in the housing 14, the angled ends 44 will prevent them from sliding out of the housing 14 into an exposed and therefore dangerous position.

The elongate metal insert strip 42 is designed so that it contacts the side walls 20 at its edges and the top wall 18 along its upper surface in the upper channel region 34 of the housing 14. Both the metal insert 42 and the top wall 18 of the housing 14 are wider than the diameter of the reinforcement bars 12 they are to guard.

FIG. 3 shows a row of reinforcement bars 12 to be placed through the space 31 so that they extend into the housing 14 and can be captured therein by the lower portions 26 of the side walls 20, and more particularly, the distal bearing surfaces 31 of the second strip portions 30.

Figure 6:
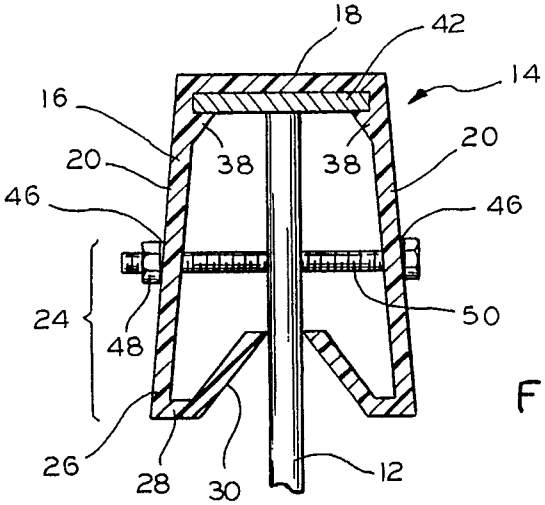
FIG. 6 is a cross-sectional view taken along the line 6—6 of FIG. 4.

As seen best in FIG. 6, a nut 48 and a bolt 50 are provided on the housing 14, and more specifically the housing side walls 20, and cooperate with the side walls 20 to allow guided movement of the side walls 20 between non-secured and guarding positions, with the bolt 50 extending through a pair of aligned holes 22 in the side walls 20. Once the bolts 50 are in place through the aligned holes 22 with the nuts 48 thereon, the nut 48 and bolt 50 can be tightened to effectively bias the side walls 20, and therefore the lower portions 26 of the side walls 20, towards one another. The tightening is continued until the reinforcement bars 12 are effectively captured between the upwardly depending portions 30 of the side walls 20, and more specifically, the distal bearing surfaces 31 of the upwardly depending portions 30 to provide a positive lock on the reinforcement bars 12 extending into the housing 14, as seen in FIGS. 4–6. In this guarding position, the reinforcement bars 12 are captured between the distal bearing surfaces 31 of the upwardly depending portions 30 of the side walls 20 and can be in contact with the metal insert 42 which extends over the reinforcement bars 12.

The height of the side walls 20 as measured from the top wall 18 down can be increased to accommodate varying lengths of reinforcement bars 12. This allows for the housing 14 to guard a row of linearly-arranged reinforcement bars 12 even when they are not of the same exposed length. Furthermore, the housing 14 with the insert 40 therein can be cut on site so that the housing 14 can accommodate a variable range of reinforcement bars 12.

While the guard rail 10 described herein is ideal for use with rows having a range of anywhere from three to ten reinforcement bars 12, the guard rail 10 can be used with various arrangements and quantities of reinforcement bars 12 with only minor changes being made in the size, shape and materials of the guard rail 10 within the scope of the appended claims and without departing from the spirit of the invention.

The foregoing disclosure of specific embodiments is illustrative of the broad inventive concept comprehended by the invention.

I claim:

1. A guard rail for use with linearly arranged reinforcement bars, comprising:

an elongate housing defining an interior space for guarding a plurality of reinforcement bars extending into said housing interior space, with the interior space having a top region and a bottom region, said housing having means for capturing reinforcement bars; and cooperating means on said housing to guide movement of said capturing means between a non-secured position and a secured position wherein in said non-secured position said capturing means is in non-contacting relation with reinforcement bars extending into said housing interior space and in said secured position said housing is securely maintained in a guarding position over reinforcement bars extending into said housing interior space and said housing is in contacting relation with reinforcement bars extending into said housing interior space.

2. The guard rail of claim 1 wherein said housing includes an insert to be placed over reinforcement bars in said guarding position wherein said cooperating means securely maintains said insert in said guarding position over reinforcement bars extending into said housing.

3. The guard rail of claim 1 wherein said cooperating means extends through said housing interior space to guide movement of said capturing means between a non-secured position and a secured position wherein said housing is securely maintained in said guarding position over reinforcement bars extending into said housing interior space.

4. A guard rail for use with linearly arranged reinforcement bars comprising:.

a housing defining an interior space for guarding reinforcement bars extending into said housing interior space, with the interior space having a top region and a bottom region, said housing having means for capturing reinforcement bars; and cooperating means on said housing to .guide movement of said capturing means between a non-secured position and a position wherein said housing is securely maintained in a guarding position over reinforcement bars extending into said housing interior space, wherein said housing is formed from plastic material and includes an insert therein, said plastic housing having a top wall bounding the top region, with two opposing side walls downwardly depending therefrom towards the bottom region, said walls cooperating to bound the interior space such that the interior space forms a channel with said capturing means comprising lower portions of said side walls extending towards each other so that reinforcement bars can be captured therebetween, and said insert comprising an elongate strip of metal extending within said housing channel adjacent said housing walls.

5. The guard rail of claim 4 wherein said insert comprises an elongate strip of metal including ends thereof with said strip extending adjacent said walls in said top region and further including means for bending the strip so that said ends extend towards said bottom region.

6. The guard rail of claim 3 wherein said metal strip is steel.

7. The guard rail of claim 3 wherein said lower portion of said side walls includes first integral strip portions extending inwardly from said side walls and second integral strip portions extending upwardly and inwardly toward said top region from said first inwardly extending strip portions.

8. The guard rail of claim 3 wherein said housing comprises an extruded plastic piece including means for severing said plastic housing so that a variable range of reinforcement bars can be guarded thereby.

9. A guard rail for use with linearly arranged reinforcement bars, comprising:

an elongate housing defining an interior space for guarding reinforcement bars extending into said housing interior space, with the interior space including top and bottom regions thereof wherein said housing is formed from a plastic material, said plastic housing having a top wall bounding the top region and two opposing side walls downwardly depending from the top wall towards the bottom region, said walls cooperating to bound the interior space such that the interior space forms a channel, an insert extending within said housing channel adjacent said top wall and overlying reinforcement bars extending into the channel, with said insert comprising an elongate strip of metal; and cooperating means on said housing side walls to guide movement thereof between a non-secured position and a secured position wherein in said non-secured position said side walls are in non-contacting relation with reinforcement bars extending into the channel and in said secured position said housing with said insert therein is securely maintained in a guarding position over reinforcement bars by said cooperating means which extends through aligned holes in said side walls of said housing.

10. The guard rail of claim 9 wherein said cooperating means includes means for biasing said housing side walls towards each other so that reinforcement bars are captured therebetween and said housing with said insert therein is securely maintained in said guarding position over reinforcement bars.

11. The guard rail of claim 9 wherein a ridge extends along each housing side wall in said top region of said housing interior space with said ridges supporting said insert in said top region of said housing interior space.

12. The guard rail of claim 9 wherein said cooperating means comprises a nut and a bolt, with said bolt extending through aligned holes in said side walls of said housing.

13. A guard rail for use with linearly arranged reinforcement bars, comprising:

a housing defining an interior space for guarding reinforcement bars extending into said housing interior space, with the interior space including top and bottom regions and wherein said housing is formed from a plastic material, said plastic housing having a top wall bounding the top region and two opposing side walls downwardly depending from the top wall towards the bottom region, said walls cooperating to bound the interior space such that the interior space forms a channel;

an insert extending within said housing channel adjacent said top wall and overlying reinforcement bars extending into the channel, with said insert comprising an elongate strip of metal; and cooperating means on said housing side walls to guide movement thereof between a non-secured position and a secured position wherein said housing with said insert therein is securely maintained in a guarding position over reinforcement bars by said cooperating means extending through aligned holes in said side walls of said housing.

wherein said housing side walls include lower portions extending towards each other so that reinforcement bars can be captured therebetween.

14. A guard rail for use with linearly arranged reinforcement bars, comprising:

a housing having an interior thereof for guarding reinforcement bars extending into said housing wherein said housing is formed from a plastic material, said plastic housing having a top wall with two side walls depending therefrom, said side walls having lower portions extending towards each other, said walls cooperating to define a channel having tipper and lower regions, said housing further including an integral ridge extending along each side wall in said upper channel region of said housing, an insert extending within said housing adjacent said housing walls and over reinforcement bars, with said insert comprising an elongate strip of metal supported by said ridges in said upper channel region of said housing; and cooperating means on said housing side walls to guide movement thereof between a non-secured position and a position wherein said housing with said insert therein is securely maintained in a guarding position over and in contact with reinforcement bars by said cooperating means extending through aligned holes in said side walls of said housing to bias said housing side walls towards each other so that reinforcement bars are captured between said lower portions of said housing side walls.

* * * * *